US010246856B2

(12) United States Patent
Rol Corredor et al.

(10) Patent No.: US 10,246,856 B2
(45) Date of Patent: Apr. 2, 2019

(54) FIXING DEVICE FOR FIXING A WEAR OR PROTECTION ELEMENT ON A BUCKET OF AN EARTH MOVING MACHINE AND CORRESPONDING FIXING METHOD AND WEAR OR PROTECTION SYSTEM

(71) Applicant: METALOGENIA RESEARCH & TECHNOLOGIES S.L., Barcelona (ES)

(72) Inventors: Javier Rol Corredor, Sant Adria del Besos (ES); Angel Martinez Mane, Mataró (ES); Sergio Lopez Requejo, Mataró (ES); Francisco Perez Soria, La Roca del Vallès (ES); Jorge Triginer Boixeda, Barcelona (ES)

(73) Assignee: METALOGENIA RESEARCH & TECHNOLOGIES S.L., Premia de Mar (ES)

( * ) Notice: Subject to any disclaimer, the term of this patent is extended or adjusted under 35 U.S.C. 154(b) by 50 days.

(21) Appl. No.: 15/552,361

(22) PCT Filed: Feb. 22, 2016

(86) PCT No.: PCT/ES2016/070108

§ 371 (c)(1),
(2) Date: Aug. 21, 2017

(87) PCT Pub. No.: WO2016/135360

PCT Pub. Date: Sep. 1, 2016

(65) Prior Publication Data

US 2018/0044895 A1 Feb. 15, 2018

Related U.S. Application Data

(63) Continuation of application No. PCT/ES2015/070119, filed on Feb. 23, 2015.

(51) Int. Cl.
*E02F 9/28* (2006.01)

(52) U.S. Cl.
CPC ..... *E02F 9/2841* (2013.01); *E02F 9/2825* (2013.01); *E02F 9/2833* (2013.01); *E02F 9/2883* (2013.01)

(58) Field of Classification Search
CPC ..... E02F 9/2841; E02F 9/2816; E02F 9/2883; E02F 9/2891; E02F 9/2825; E02F 9/2833; E02F 9/2875

(Continued)

(56) References Cited

U.S. PATENT DOCUMENTS 2,618,873 A 11/1952 Hostetter
4,611,418 A * 9/1986 Launder ..... E02F 9/2841 172/750

(Continued)

FOREIGN PATENT DOCUMENTS

EP 2241683 A1 10/2010
WO 2003080946 A1 10/2003

OTHER PUBLICATIONS

International Search Report, PCT/ES2016/070108, dated May 20, 2016.

*Primary Examiner* — Robert E Pezzuto
(74) *Attorney, Agent, or Firm* — Porzio Bromberg & Newman P.C.

(57) ABSTRACT

The present invention relates to a fixing device for fixing a wear or protection element on a bucket of an earth moving machine, comprising: a base with a housing with a front wall and a rear wall with a through hole, a stop with a lower part housed in the housing, a screw having a head going through the hole and having an end thereof fixed to the stop and a partially compressed elastic device arranged between the screw and the hole. When the elastic device is fully compressed it has a length of L0. In a mounted position, the stop (Continued)

has a front face opposite the front wall, where the distance between both is D1 and the distance between the head and the hole has a value of D2, and the condition of D2−L0>D1 is met in the mounted position.

16 Claims, 11 Drawing Sheets

(58) Field of Classification Search
USPC ..... 37/446, 452–460; 172/750–753; 403/374.4
See application file for complete search history.

(56) References Cited

U.S. PATENT DOCUMENTS

| | | | | |
|---|---|---|---|---|
| 6,209,238 | B1 * | 4/2001 | Ruvang | E02F 9/2825 37/455 |
| 6,240,663 | B1 | 6/2001 | Robinson | |
| 7,219,454 | B2 * | 5/2007 | Maher | E02F 9/2833 172/753 |
| 2014/0202049 | A1 | 7/2014 | Ruvang | |
| 2014/0360060 | A1 * | 12/2014 | Kunz | E02F 9/2833 37/455 |

* cited by examiner

FIXING DEVICE FOR FIXING A WEAR OR PROTECTION ELEMENT ON A BUCKET OF AN EARTH MOVING MACHINE AND CORRESPONDING FIXING METHOD AND WEAR OR PROTECTION SYSTEM

FIELD OF THE INVENTION

The invention relates to a fixing device for fixing a wear or protection element on a bucket of an earth moving machine.

The invention also relates to a fixing method for fixing a wear or protection element in a mounted position on a bucket of an earth moving machine by means of a fixing device according to the invention.

The invention also relates to a wear or protection system for a bucket of an earth moving machine.

State of the Art

There is a plurality of earth moving machines, such as, for example, excavators or loaders for construction jobs, mining, etc. They generally have a shovel or bucket in which the material is collected. The shovel or bucket is subjected to significant stresses and major wear, particularly in the area of the lip (also referred to as blade). As a result, generally the lips usually have a plurality of built-in protection or wear elements:

- teeth: has the function of penetrating the ground and protecting the blade of the bucket or shovel,
- tooth bar or adapter: have the function of protecting the blade and, particularly, bearing teeth,
- front guards: protect the lip in the areas comprised between the teeth and also perform a penetration function, but to a lesser degree than the tooth,
- side guards: protect the sides of the shovel or bucket.

All these elements, normally referred to as wear or protection elements, are subjected to intense mechanical requirements, plastic deformations and intense wear. For this reason, they must normally be replaced as often as necessary, when the wear sustained requires doing so. Wear or protection elements can be fixed mechanically (easier and faster to change) or they can be welded (less expensive but difficult to change, and entailing the risk of damaging the blade with the weld), depending on degree of ground abrasiveness and machine dimensions. The front guards, side guards and mechanical adapters are fixed directly on the blade by means of a securing system, so in unloading jobs in which the material and forces act on the back part of the guards and adapters, the forces that the guards, the adapters and their fixing system receive are very high, and they tend to separate these elements from the blade and break securing systems.

A particularity of the guards and some mechanical adapters is that once they are mounted, they make contact with the blade in the front part. Due to stresses resulting from the job, the front parts of the blade deteriorate and must be repaired or rebuilt for which purpose the machine must be stopped, increasing the machine operating cost and reducing machine productivity.

There are several fixing systems for fixing the wear or protection elements on the lip of the bucket, such as those disclosed in patent documents US 2014/0202049 and WO 03/080946.

During normal working conditions, the wear or protection elements are subjected to a plurality of stresses in various directions. Fixing systems in the state of the art are normally designed to suitably withstand forces acting on the wear or protection element, pushing it towards the interior of the bucket, i.e., against the lip and side of the shovel or bucket, during the material loading movement (hereinafter referred to as "loading forces"). However, wear or protection elements are also subjected to forces that tend to separate them from the lip when unloading the material from the bucket ("unloading forces"). This is particularly important in the case of wear or protection elements with a mechanical fixing system (i.e., those that are not welded to the bucket). In fixing systems in the state of the art, this stress is usually withstood by more "delicate" components of the fixing system, such as setscrews, for example. This makes it necessary to suitably size these elements and/or use stronger materials, with the subsequent price increase. Nonetheless, the presence of fractures in these elements is not uncommon.

DESCRIPTION OF THE INVENTION

The object of the invention is to overcome these drawbacks. This objective is achieved by means of a fixing device for fixing a wear or protection element on a bucket of an earth moving machine, characterized in that it comprises:

- a base, where said base comprises a housing with a front wall and a rear wall, and where said rear wall has an access extending from said housing and defining a longitudinal axis,
- a stop, with a lower part suitable for being housed in the housing of the base,
- a screw with a first end provided with a head and a second end, and
- elastic means, the lower part of the stop thereof being housed in the housing and the screw going through the access of the rear wall of the base and one of said first end or second end being fixed on the stop in a mounted position, such that the other one of said first end or second end is located on the side of the access opposite the housing, and the elastic means are arranged between

[a] the head and the access, when the second end is fixed on the stop, or

[b] a nut arranged on the second end and the access, when the first end is fixed on the stop, and the elastic means are partially compressed, the elastic means having a length of value L0 in the direction of said longitudinal axis when they are fully compressed, the stop having a front face opposite the front wall and a rear face opposite the rear wall in the mounted position, the elastic force of the elastic means pushing the rear face towards the rear wall, and the distance between the front face and the front wall in the longitudinal direction having a value D1, in the mounted position, the distance in the longitudinal direction, between

[a] the head and the access (in particular, the end of the access facing the head of the screw), when the second end is fixed on the stop, or

[b] the nut arranged on the second end and the access (in particular, the end of the access facing the nut), when the first end is fixed on the stop, having a value D2, and D2−L0>D1 in the mounted position.

In fact, as will be seen with further clarity in the examples discussed below, if the wear or protection element is subjected to unloading stress, the wear or protection element may shift forward (away from the bucket), taking the stop with it, until the stop comes into contact with the front wall of the housing. The unloading stress will thereby be transmitted from the wear or protection element to the base through the stop and not through the screw, because the elastic elements are capable of absorbing this shift without actually reaching their minimum length L0 corresponding to the fully compressed state. It can thereby be assured that the screw will always be subjected only to the force generated by the elastic means and will not be subjected to external excessive stresses having values that would hardly be quantifiable and foreseeable.

The fixing device remains tightly drawn back such that the wear or protection element is also tightly drawn back permanently, which causes less or slower-acting wear on the front part of the blade, delaying changing the wear or protection element, reducing machine downtime and operating costs and increasing machine productivity.

The normal working direction of the bucket, which coincides with the aforementioned longitudinal axis of the access of the rear wall of the base and defines "forward", which is in the direction away from the bucket, and "back", which is in the direction towards the interior of the bucket, has been taken into account in the present description and claims.

The stop has an upper part which projects from the housing in the mounted position. This upper part is inside an opening provided in the wear or protection element and is what will receive stresses from the wear or protection element and transmit them through the aforementioned front or rear walls (which are in a lower part of the stop) to the base.

In the present description and claims, "mounted position" has been defined as that position in which the fixing device is in conditions of being used, but without it being subjected to external stresses. In other words, it is the position in which the fixing device is located once the operator fixes the wear or protection element on the lip of the bucket up to the working position.

The elastic means can be compressed to a limit, after which it is not possible to further compress them in a reversible manner. This limit is what has been considered as the state of "fully compressed elastic means", and in this situation the length thereof is L0. The elastic means are partially compressed in the mounted position, so the length thereof is always greater than L0.

In fact, the screw is, in general, a connection element with variable length between the base and the stop, which compresses the elastic means against the rear wall of the base. In this way, the elastic force of the partially compressed elastic means pushes the screw back and, given that the screw is integral with the stop, the stop is also pushed back, that is, towards the rear wall of the base. In order to perform this function, the screw may be arranged in two different ways:

- in one case, the second end of the screw is fixed on the stop and the head is faced back, being arranged on the side of the access opposite the housing,
- in the other case, the position of the screw is reversed, being the first end (that is, the head) fixed on the stop and the second end being faced back, being arranged on the side of the access opposite the housing. In this alternative, there is always a screwed nut in the second end, which will fasten the elastic means and will compress them against the rear wall of the base.

Depending on the location of the screw, the reference to measure value D2 will be the head or the nut, respectively.

Thus, when the second end of the screw is fixed on the stop and the head is faced back, this is a preferred embodiment of the invention which, in particular, consists of a fixing device of the type indicated before, characterized in that it comprises:

- a base, where the base comprises a housing with a front wall and a rear wall, and where the rear wall has a through hole extending from the housing and defining a longitudinal axis,
- a stop, with a lower part suitable for being housed in said housing,
- a screw, and
- elastic means, the lower part of the stop thereof being housed in the housing and the screw going through the hole and having the second end thereof fixed on the stop in a mounted position, such that the head thereof is located on the side of the hole opposite the housing, and the elastic means are arranged between the screw (in particular, the head of the screw) and the hole and are partially compressed, the elastic means having a length of value L0 in the direction of the longitudinal axis when they are fully compressed, the stop having a front face opposite the front wall and a rear face opposite the rear wall in said mounted position, the elastic force of the elastic means pushing the rear face towards the rear wall (keeping the wear or protection element tightly drawn back), and the distance between the front face and the front wall in the longitudinal direction having a value D1, the distance in the longitudinal direction between the head of the screw and the hole (specifically, the end of the hole facing the head of the screw) having a value D2 in the mounted position, and, in the mounted position, $D2-L0>D1$.

The stop preferably has a second through hole, coaxial with the hole, and has a nut housed in said second through hole, the nut is screwed onto said screw in said mounted position.

Alternatively, the stop has a second hole, coaxial with the hole, and an upper hole which is in contact with the second hole, and has a nut housed in the second hole, the upper hole having a cross-section suitable for allowing the passage of the nut and the nut being screwed onto the screw in the mounted position.

The base preferably has a safety wall with a safety hole, coaxial with the hole, the head of the screw being located between the hole and the safety wall in the mounted position, the distance between the hole and the safety wall being less than the length of the screw in the axial direction, and the safety hole having a helical surface coaxial with the safety hole, and the head of the screw having a second helical surface complementary to the helical surface, such that the screw is only suitable for passing through the safety hole by means of rotation when both helical surfaces are facing one another. This safety device (formed by the screw and safety wall with the safety hole, with the corresponding helical surfaces) allows preventing the screw from coming out of the fixing device in the event that said screw should become unscrewed.

The fixing device advantageously comprises positioning means for positioning the screw in the mounted position. The operator can therefore know in a simple manner when the screw (and therefore the entire fixing device) has reached the mounted position.

When the first end of the screw (that is, the head) is fixed on the stop and the second end of the screw is faced back, this is another preferred embodiment of the invention which, in particular, consists of a fixing device of the type mentioned before, characterized in that it comprises:

a base, where the base comprises a housing with a front wall and a rear wall, and where the rear wall has an access extending from the housing and defining a longitudinal axis, a stop, with a lower part suitable for being housed in the housing, a screw, with a first end provided with a head and a second end, and elastic means, the lower part of the stop thereof being housed in the housing of the base and the screw going through the access and having the first end thereof fixed on the stop in the mounted position, such that the second end is located on the side of the access opposite the housing, and the elastic means are arranged between a nut arranged on the second end and the access and are partially compressed, the elastic means having a length of value L0 in the direction of the longitudinal axis when they are fully compressed, the stop having a front face opposite the front wall and a rear face opposite the rear wall in the mounted position, the elastic force of the elastic means pushing the rear face towards the rear wall, and the distance between the front face and the front wall in the longitudinal direction having a value D1, the distance in the longitudinal direction between the nut arranged on the second end and the access having a value D2 in the mounted position, and, in the mounted position, D2−L0>D1.

In this embodiment, the access provided in the rear wall may substantially be shaped as an open duct at the lower part thereof, or may be a hole with a diameter sufficiently high for allowing the passage of the head of the screw, but sufficiently low for preventing the passage of the elastic means. The preferred solution is that the access would actually be a hole, given that it is thereby possible to fix the base on the bucket without the screw and it is possible to subsequently put the screw in place. In turn, in order to fix the first end (the head) of the screw on the stop, the stop preferably includes a cavity suitable for housing the head of the screw and a rear hole aligned with the access, through which the bolt shank will come out, but that will prevent the head from coming out. This cavity has a side opening, at the lower part of the stop, through which it is possible to introduce the head in the cavity and the shank in the rear hole. Preferably, the fixing device has a second nut adjacent to the nut at the side opposite the elastic means. This second nut allows to lock the nut in a certain position and to prevent it from moving as a result of the vibrations and shocks derived from the use of the earth moving machine. Another advantageous solution is replacing the nut and the second nut by a self-locking nut.

The screw advantageously has a threaded end part and a non-threaded intermediate part. Thereby the threaded end part limits the maximum screwing that the operator must perform when mounting the fixing device. In fact, it is necessary that the elastic means are not excessively compressed while mounting the fixing device because this affects the value of the distance D2. By limiting the threaded segment of the screw, it is assured that the operator will never tighten the elastic means too much. The operator must simply screw it in as far as the threaded segment of the screw allows, and knows that the remaining distance D2 is suitable for the fixing device to work correctly. In other words, the mounted position is defined when the nut reaches the end of the threaded part of the screw. As can be seen, the presence of the intermediate part provides the function of positioning means, which allow positioning the screw (or the nut) in the mounted position. However, it would be possible to use any other positioning means, such as position marks in the base, for example, which can be used as a reference for suitably positioning the head of the screw (or the nut), or even, for example, a torque wrench tared to a torque having a pre-established value (or even the operator simply knowing how many turns to be given to the screw or to the nut).

The screw preferably has a threaded part in which the screw thread has a rectangular cross-section. Given the working conditions of the screw, in which it will never have to withstand stresses greater than those generated by the elastic means, the screw thread having a rectangular cross-section is the most suitable because it is stronger and the threading does not deteriorate as quickly because it has a larger section.

The elastic means are advantageously a coil spring. The coil spring has a particularly simple and effective geometry which can furthermore be mounted around the screw shank, which simplifies handling and mounting.

In some circumstances when the mechanical requirements are more demanding, the wear or protection element is prone to move somewhat with respect to the stop, whereby fines enter the system and build up therein, being able to shift the stop upwards and bending the screw. If the screw is bent, it becomes very hard or impossible to demount the wear element, whereby it would have to be removed with a blowtorch, ruining the base, the stop and the wear element. To solve this problem, the stop is preferably provided with at least one rib, preferably on the rear face thereof, the upper edge of which is below the lower edge of the opening of the wear or protection element in said mounted position, and it has the function of coming into contact with an inner wall of the wear or protection element (preferably with the lower edge itself of said opening) when the stop is prone to be lifted up, thereby preventing this movement.

Another object of the invention is a fixing method for fixing a wear or protection element in a mounted position on a bucket of an earth moving machine by means of a fixing device according to the invention (where the second end of the screw is fixed on the stop), the wear or protection element comprising an opening, characterized in that it comprises the steps of:

[a] positioning the wear or protection element on the base,

[b] inserting the stop in the opening such that the lower part is housed in the housing, the front face is opposite the front wall and the rear face is opposite the rear wall,

[c] fixing the screw on the stop by means of a screw-in movement, the head thereof being located on the side of the hole opposite the housing, and the elastic means being arranged between the screw and the hole, the screw-in movement ending before the elastic means are fully compressed, the elastic force of the elastic means pushing the rear face towards the rear wall until coming into contact with a rear wall of the opening, the distance between the front face and the front wall in the longitudinal direction having a value D1, the distance in the longitudinal direction between the head and the hole (21) having a value D2 and the condition D2−L0>D1 being met when the screw-in movement has ended and the mounted position has been reached.

Similarly, in case that the first end of the screw (the head) is fixed on the stop, the object of the invention is also a fixing method for fixing a wear or protection element in a mounted position on a bucket of an earth moving machine by means of a fixing device according to the invention, said wear or protection element comprising an opening, characterized in that it comprises the steps of:

[a] positioning the wear or protection element on the base,

[b] inserting the stop in the opening such that the lower part is housed in the housing, the front face is opposite the front wall and the rear face is opposite the rear wall, and such that the first end (the head) of the screw, being the shank of the screw previously housed in the access, is fixed on the stop,

[c] fixing the screw on the stop by means of a screw-in movement, the elastic means thereof being located between the nut and the access, the screw-in movement ending before the elastic means are fully compressed, the elastic force of the elastic means pushing the rear face towards the rear wall until coming into contact with a rear wall of the opening, the distance between the front face and the front wall in the longitudinal direction having a value D1, the distance in the longitudinal direction between the nut and the access having a value D2, and the condition D2−L0>D1 being met when the screw-in movement has ended.

The method can include a prior step of fixing the base on the bucket (by welding, for example), although this prior step may not be necessary, for example in the case of replacing a damaged wear or protection element and observing that the base does not require being changed.

Another object of the invention is a wear or protection system for a bucket of an earth moving machine, characterized in that it comprises a fixing device according to the invention (where the second end of the screw is fixed on the stop) and a wear or protection element with an opening, where in a mounted position the wear or protection element is arranged on the base, the stop is arranged in the opening such that the lower part is housed in the housing, the front face is opposite the front wall and the rear face is opposite the rear wall, the screw is fixed on the stop, the head thereof being located on the side of the hole opposite the housing, and the elastic means being arranged between the screw and the hole, the elastic means being partially compressed, the elastic force of the elastic means pushing the rear face towards the rear wall until coming into contact with a rear wall of the opening, the distance between the front face and the front wall in the longitudinal direction having a value D1, the distance in the longitudinal direction between the head and the hole having a value D2 and the condition D2−L0>D1 being met.

Similarly, another object of the invention is a wear or protection system for a bucket of an earth moving machine, characterized in that it comprises a fixing device according to the invention (where the first end of the screw is fixed on the stop) and a wear or protection element with an opening, where in a mounted position the wear or protection element is arranged on the base, the stop is arranged in the opening, such that the lower part is housed in the housing, the front face is opposite the front wall and the rear face is opposite the rear wall, the screw is fixed on the stop, the second end thereof being located on the side of the access opposite the housing, and the elastic means being arranged between the screw and the access, the elastic means being partially compressed, the elastic force of the elastic means pushing the rear face towards the rear wall until coming into contact with a rear wall of the opening, the distance between the front face and the front wall in the longitudinal direction having a value D1, the distance in the longitudinal direction between the nut and the access having a value D2, and the condition D2−L0>D1 being met.

BRIEF DESCRIPTION OF THE DRAWINGS

Other advantages and features of the invention can be seen from the following description in which preferred non-limiting embodiments of the invention are described in reference to the attached drawings, where.

DETAILED DESCRIPTION OF EMBODIMENTS OF THE INVENTION

As will be seen below in the detailed description of embodiments of the invention, the wear or protection element depicted is a front blade guard. However, as has already been indicated above, the wear or protection element can be any other element compatible with the fixing device according to the invention, such as side guards and mechanical adapters, for example (see FIG. 17).

Figure 1:
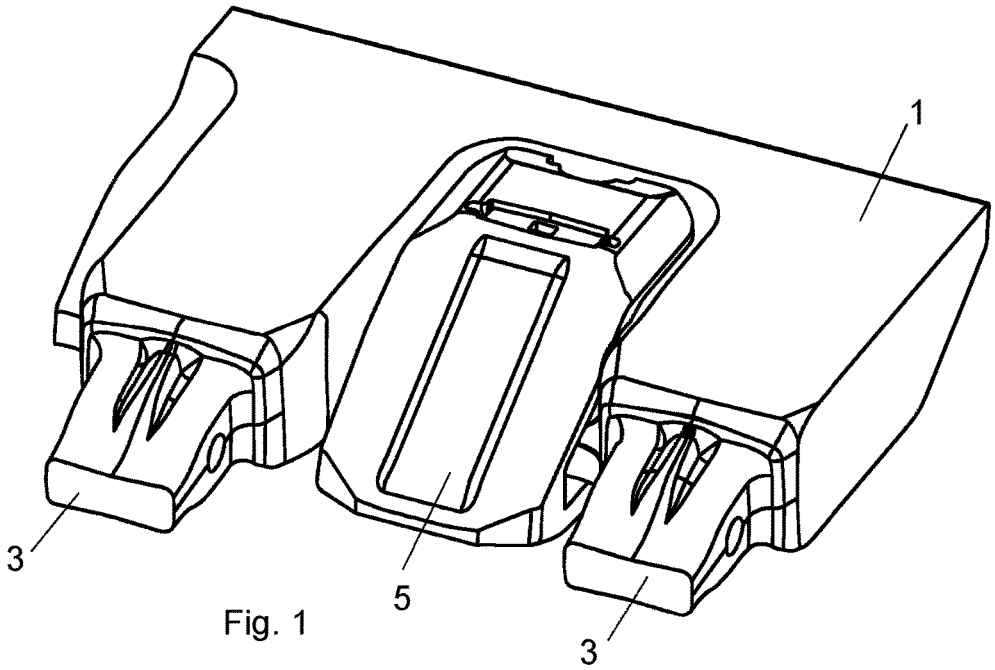
FIG. 1 shows a partial perspective view of a lip of an excavator bucket with a wear or protection element, specifically a front guard, fixed thereon.
Figure 2:
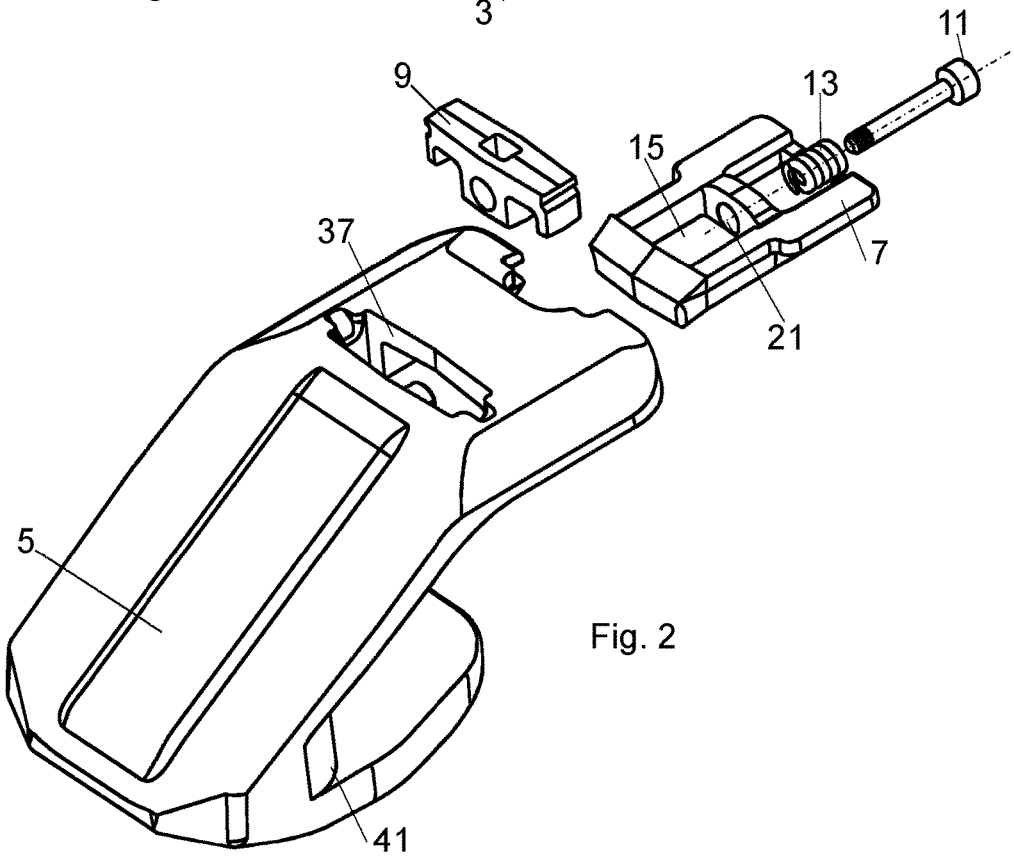
FIG. 2 shows an exploded view of a wear or protection element, specifically a front guard, with a first embodiment of a fixing device according to the invention.
Figure 3:
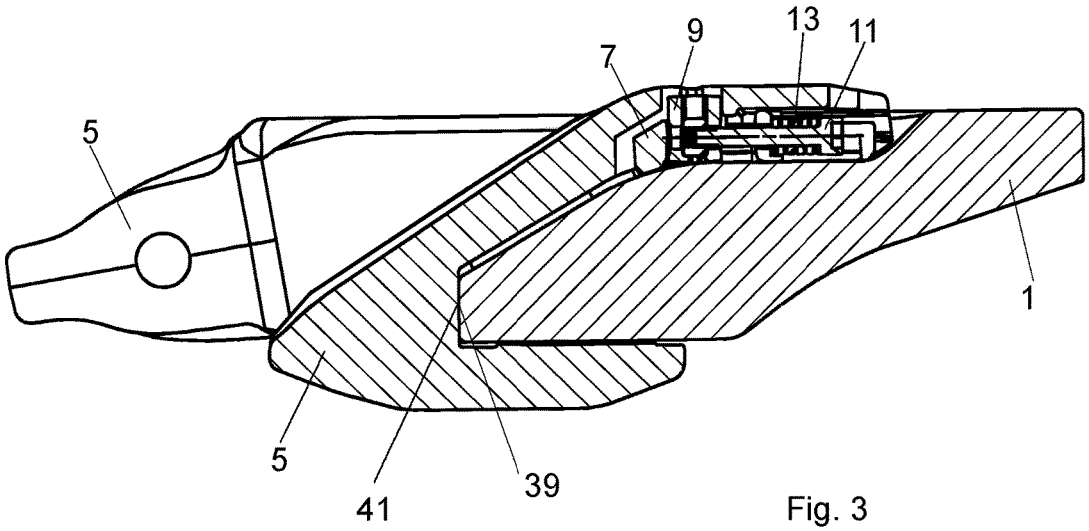
FIG. 3 shows a longitudinal section of the lip with the guard of FIG. 1, in the mounted position.

FIG. 1 shows a segment of the lip 1 of an excavator bucket in which a front guard 5 is mounted between two projections 3 provided for bearing two teeth. As can be seen in FIGS. 2 and 3, the guard 5 is fixed on the lip 1 by means of a fixing device according to the invention comprising a base 7, a stop 9, a screw 11, and elastic means 13, which are a coil spring in this specific case.

Figure 4:
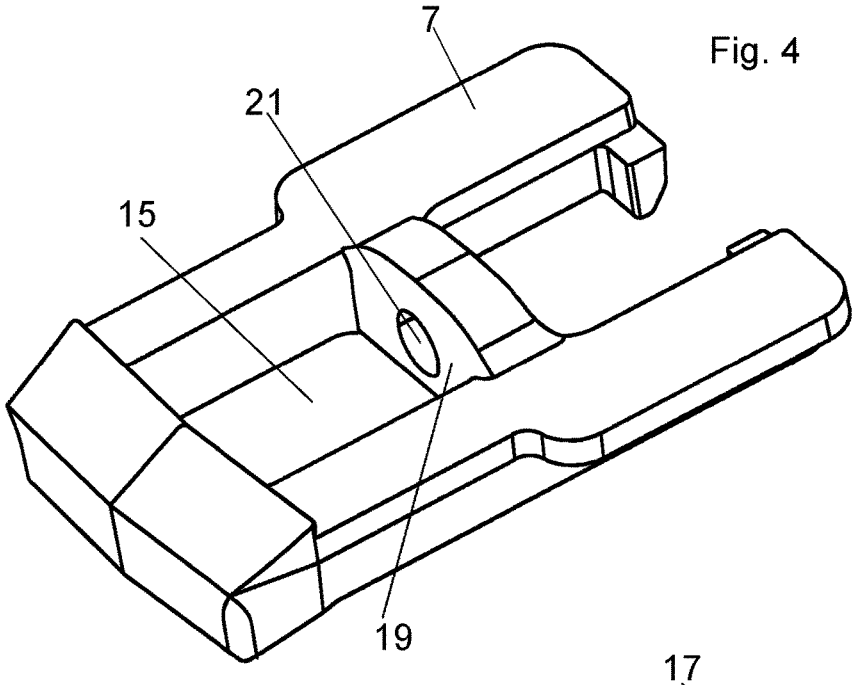
FIGS. 4 and 5 show front and rear perspective views, respectively, of the base of the fixing device of FIG. 2.
Figure 5:
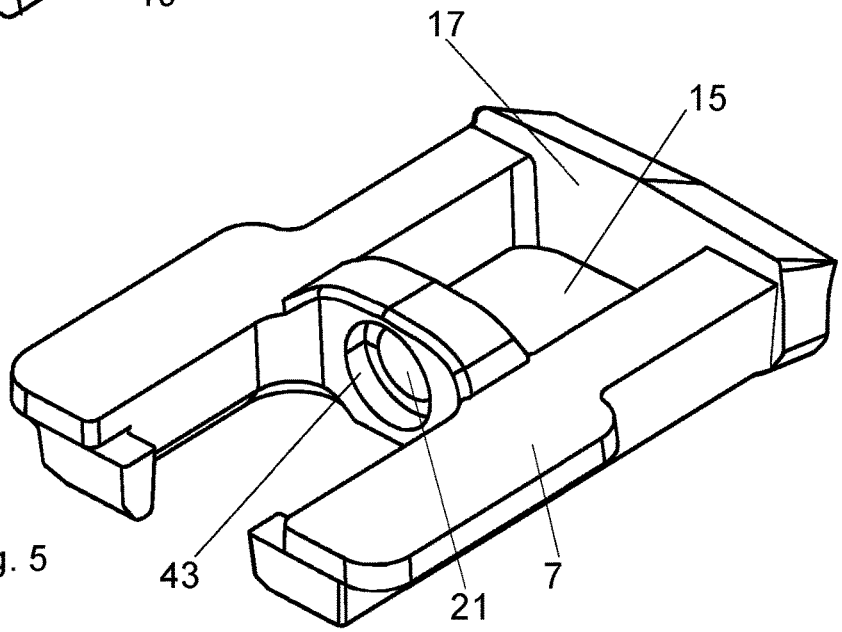

The base 7 (also see FIGS. 4 and 5) is attached to the lip 1, normally by means of welding. The base 7 has a housing 15 with a front wall 17 and a rear wall 19. The rear wall 19 has an access 21 extending from the housing 15 towards the rear part of the base 7, defining a longitudinal axis.

The stop 9 (also see FIGS. 6 and 7) has an upper part 23, a lower part 25, a front face 27 and a rear face 29. The stop 9 has a second access 31 which is coaxial with the hole 21 in the mounted position. The stop 9 furthermore has an upper hole 33 through which a nut 35 can be inserted. The upper hole 33 is in contact with the second hole 31, such that the nut 35 is facing and aligned with the second hole 31, and therefore with hole 21, when it is in the mounted position. As can be seen, the second hole 31 does not have to be an access. In another embodiment alternative, the stop 9 may not have the upper hole 33, and the nut 35 can be housed in the front end of the second access 31.

The guard 5 is mounted on the lip 1 such that the base 7 is housed between the interior of the guard 5 and the upper face of the lip 1, and such that the housing 15 is below an opening 37 arranged on the upper face of the guard 5. The stop 9 is introduced through this opening 37 such that the lower part 25 of the stop 9 is housed in the housing 15, whereas the upper part 23 of the stop 9 projects from the housing 15 and is housed in the opening 37. The screw 11, with the spring 13, is introduced in the rear part of the guard 5 and base 7, goes through the hole 21 and the second hole 31, and is screwed into the nut 35.

Figure 6:
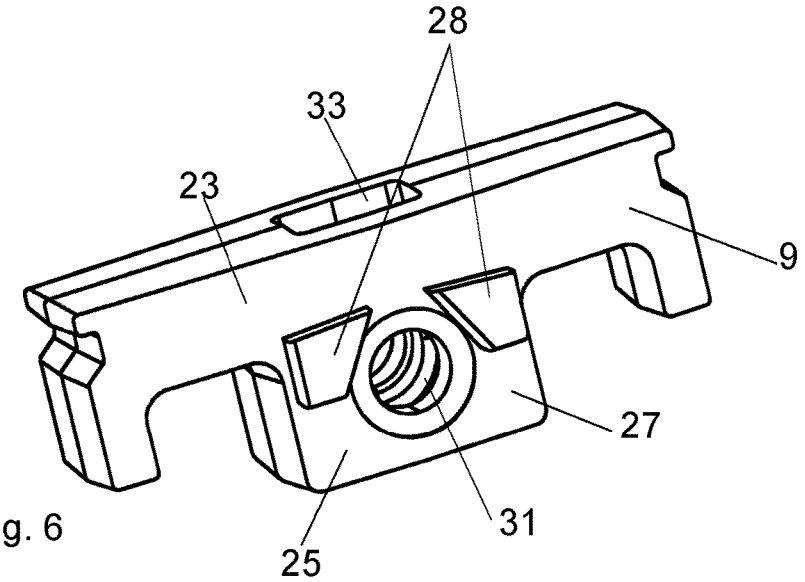
FIGS. 6 and 7 show front and rear perspective views, respectively, of the stop of the fixing device of FIG. 2.
Figure 7:
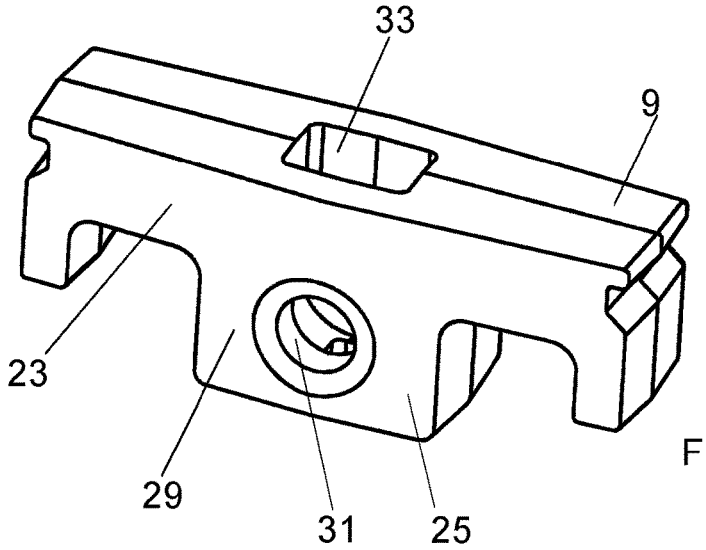
Figure 8:
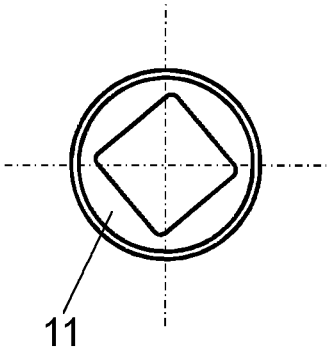
FIGS. 8 and 9 show plan and front elevational views of the screw of the fixing device of FIG. 2.
Figure 9:
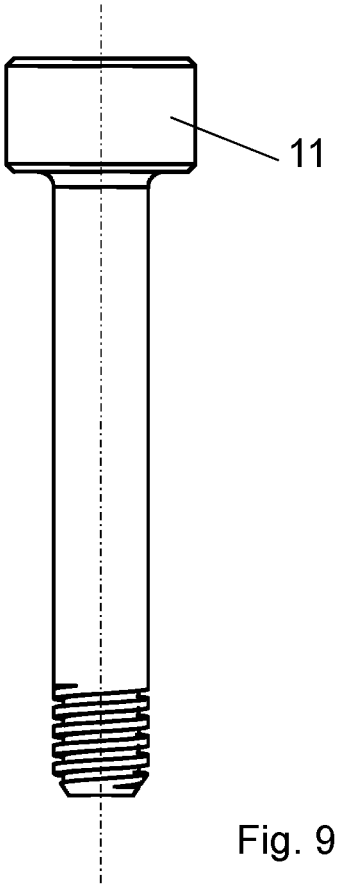

The stop 9 shown in FIGS. 6, 11 and 12 has two ribs 28 on the rear face thereof, the upper edge of which is below the lower edge of the opening 37 of the wear or protection element 5 in the mounted position. If the stop 9 is prone to be lifted up, the upper edge of the ribs 28 comes into contact with the inner wall of the wear or protection element 5, specifically with the lower edge itself of the opening 37, blocking this movement.

Figure 10:
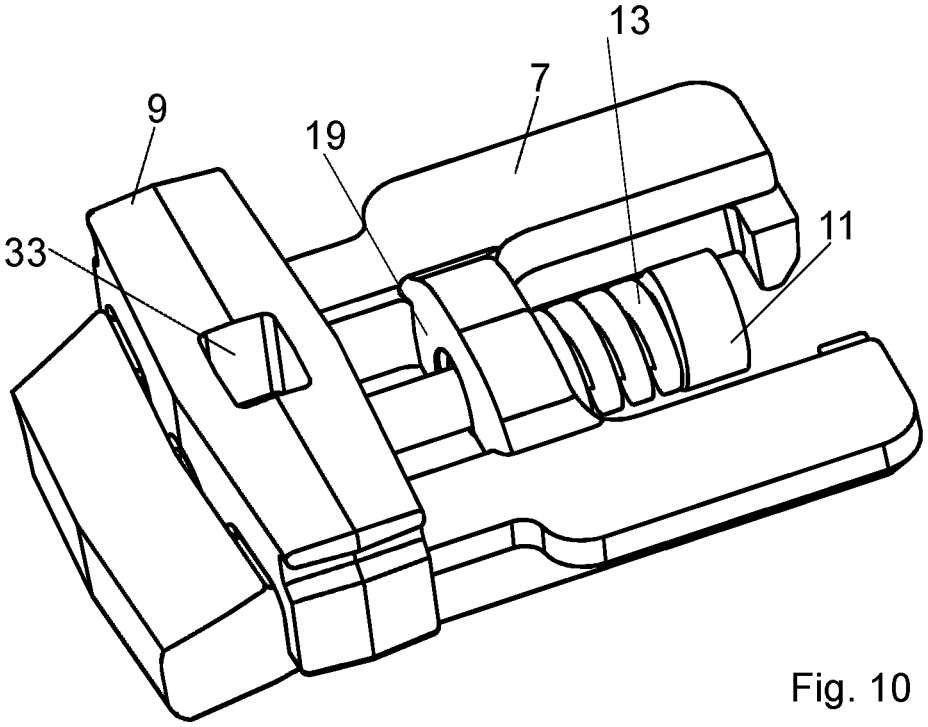
FIG. 10 shows a perspective view of the fixing device of FIG. 2 now assembled. The lip and guard have been omitted for greater clarity.

FIG. 10 shows the fixing device assembled. Both the lip 1 and the guard 5 have been omitted in order to more clearly see the relative position of the various elements of the fixing device. The lower part 25 of the stop 9 is inside the housing 15 of the base 7. The housing 15 is wider in the longitudinal direction than the lower part 25 of the stop 9, such that the stop 9 can shift in the longitudinal direction. The screw 11 goes through the hole 21 of the base 7 and is introduced through the second hole 31 of the stop 9 in the interior thereof. A nut 35 (not seen in this drawing), which is screwed onto the threaded end of the screw 11, has been introduced through the upper hole 33 of the stop 9. The spring 13 is located between the hole 21 and the head of the screw 11. Generally, the spring tension of the spring 13 is prone to push the stop 9 towards the rear wall 19 of the base 7 until coming into contact with the rear wall of the opening 37 of the guard 5.

Figure 11:
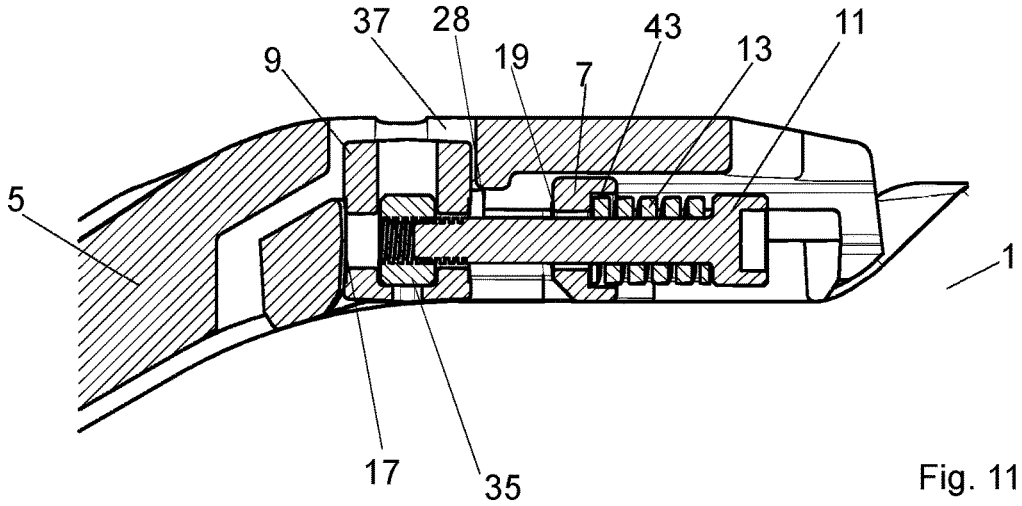
FIG. 11 shows an enlarged view of the longitudinal section of FIG. 3, but before the screw has been screwed in until reaching the mounted position.
Figure 12:
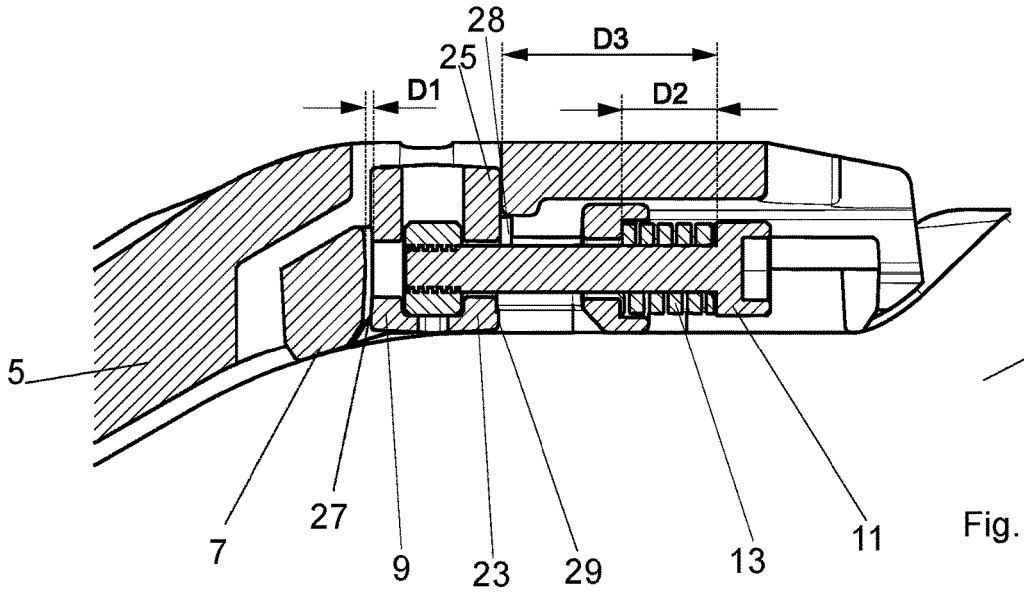
FIG. 12 shows an enlarged view of the longitudinal section of FIG. 3.

FIG. 11 shows a longitudinal section equivalent to that of FIG. 3 but before the screw 11 has been screwed in until reaching the mounted position. In this position the spring 13 is still not subjected to any compressive stress. FIG. 12 shows an enlarged view of FIG. 3, i.e., when the fixing device is in the mounted position. At this time, the screw 11 is completely screwed into the nut 35, and the spring 13 is partially compressed, i.e., it is already generating a force that is prone to move the stop 9 towards the rear wall 19 of the base 7 but is not fully compressed, i.e., it can still can be further compressed, its length thereby being reduced. In this mounted position, the spring 13 pushes the screw 11 and, accordingly, the nut 35 and stop 9 back (towards the interior of the bucket). The rear face of the upper part 23 of the stop 9 is in contact with the guard 5, and therefore the guard 5 is also pushed back until, as can be seen in FIG. 3, the front edge 39 of the lip 1 is in contact with the inner edge 41 of the guard 5. In these conditions, the fixing device is tightly drawn back. Distance D2, which is the distance between the head of the screw 11 and the hole 21 (or in other words, the length of the spring in the mounted position, i.e., partially compressed), and distance D3, which is the distance between the head of the screw 11 and the rear face 29 of the stop 9 (or in other words, between the head of the screw 11 and the second hole 31), are defined in this mounted position. As can be seen in the example shown, the base 7 has an annular step 43 forming an edge on the end of the spring 13. This step 43 (which is optional) is coaxial with the hole 21 but must not be taken into account when calculating distance D2, i.e., distance D2 must be calculated based on the bearing point of the spring 13. Distance D1, which is the distance between the front face 27 of the stop 9 and the front wall 17 of the housing 15, is also defined.

In the event that the guard 5 is subjected to loading forces, these loading forces are directly transmitted to the lip 1. In the case of plastic deformation or wear of the front edge 39 of the lip 1 and/or of the inner edge 41 of the guard 5, the tension of the spring 13 allows compensating for this wear or deformation and maintaining said contact. In other words, the guard is tightly drawn back at all times, thereby eliminating the gap that is generated due to wear. It can therefore be seen that distance D1 increases. However, distance D2 increases by the exact same amount. Therefore, if the condition $D2-L0>D1$ is met in the initial mounted position (with new elements not yet subjected to wear), this condition continues to be met even though the elements have been subjected to wear.

In the event that the guard 5 is subjected to unloading forces, the guard 5 is prone to shift away from the bucket, taking the stop 9 with it. This causes the screw 11 to also shift away from the bucket and the spring 13 to be further compressed, thereby reducing the length thereof. However, at no time does the spring 13 reach its fully compressed state, so the stop 9 can shift away from the bucket until coming into in contact with the front wall 17 of the housing 15. The unloading forces are thereby transmitted from the guard 5 to the base 7 through the stop 9, and the screw 11 is not subjected to these unloading forces.

Figure 13:
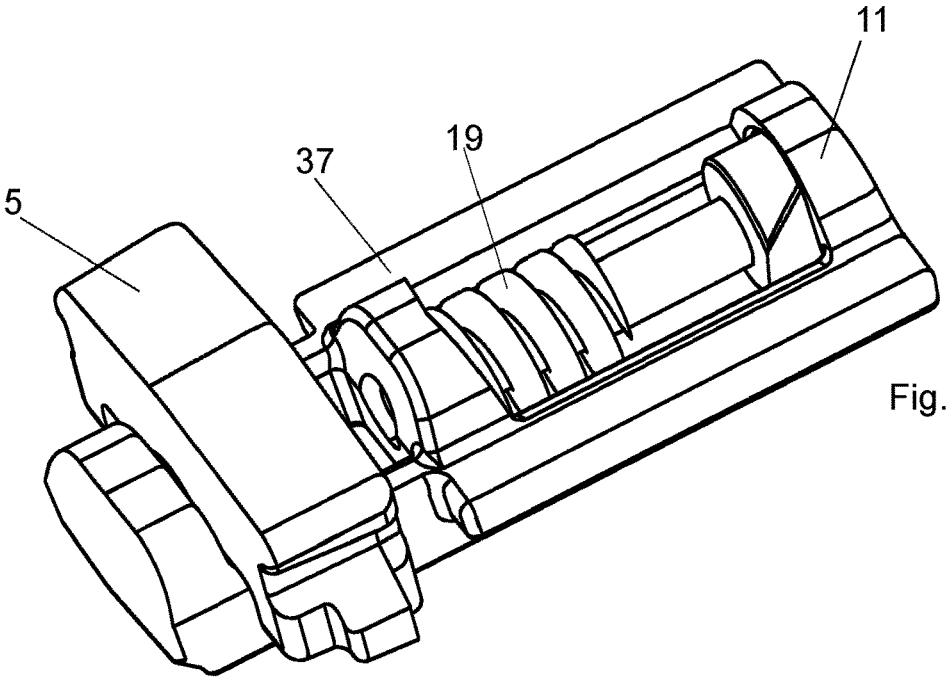
FIG. 13 shows a perspective view of another embodiment of a fixing device according to the invention.
Figure 14:
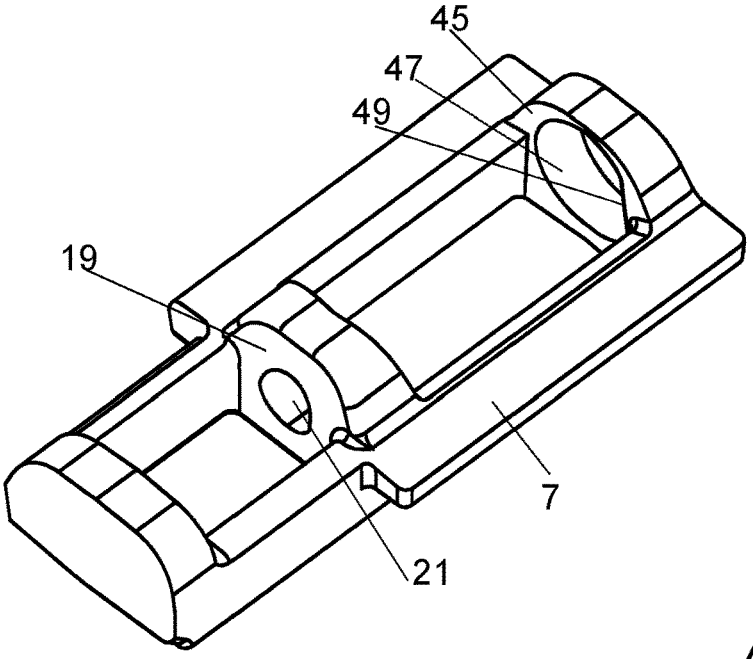
FIG. 14 shows a perspective view of the base of the device of FIG. 13.
Figure 15:
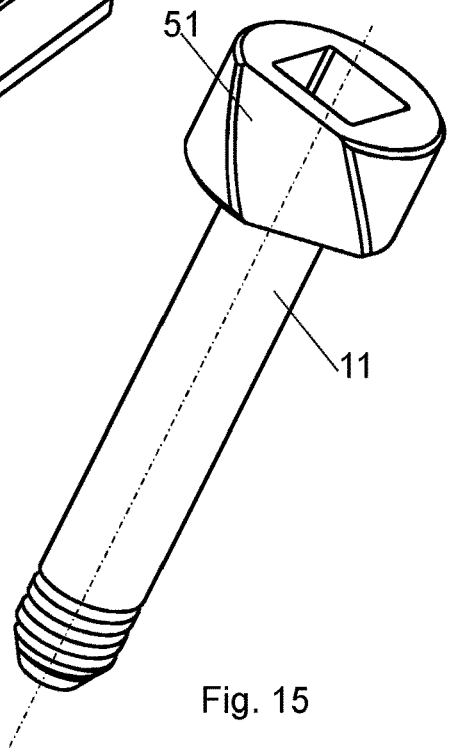
FIG. 15 shows a perspective view of the screw of the device of FIG. 13.

FIGS. 13 to 15 show a fixing device additionally comprising a safety device. The safety device includes a safety wall 45 having a safety hole 47. The safety hole 47 has a helical surface 49. The safety device also includes a screw 11 with a second helical surface 51. The distance between the hole 21 and the safety hole 47 is less than the total length of the screw 11. Therefore the only way to take the screw 11 out of the base 7 is through the safety hole 47. However, for the screw 11 to go through the safety hole 47, first of all the helical surface 49 and the second helical surface 51 must be located one right after the other, and second of all the screw 11 must be simultaneously subjected to a translational movement towards the back and rotational movement which allow the second helical surface 51 to "follow" the helical surface 49. Such movement is characteristic of the screw-in movement when the assembly is mounted, so mounting the assembly is not hindered, but it is highly unlikely that it will occur spontaneously while the excavator bucket is operating.

Figure 16:
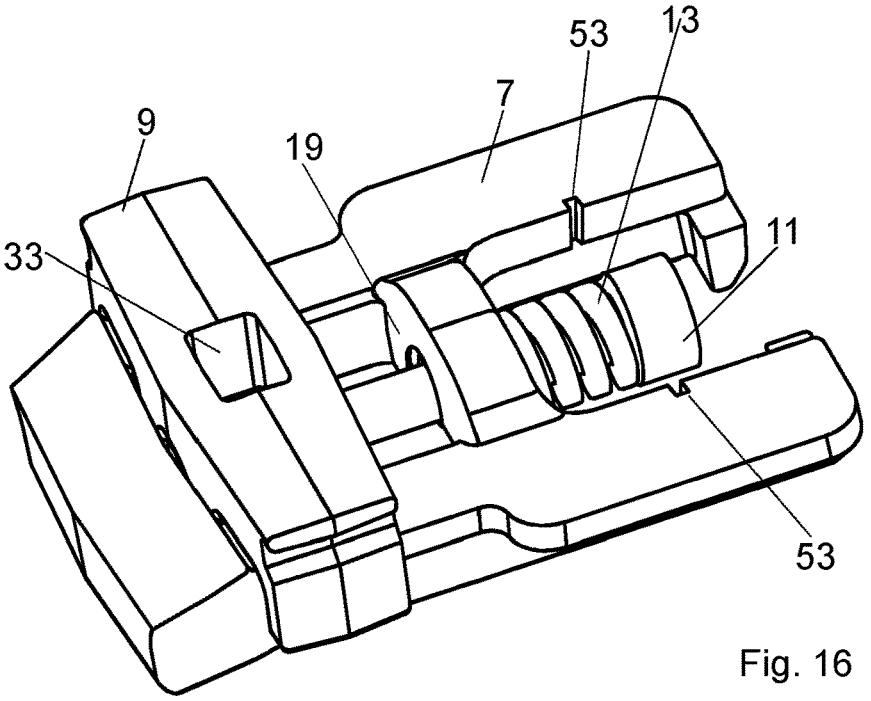
FIG. 16 shows a perspective view of a fixing device similar to that of FIG. 2, assembled and with marks forming positioning means.

FIG. 16 shows a fixing device in which the base 7 includes marks 53 defining positioning means. These marks 53 are located a distance away from the hole 21 that is equal to D2 plus the thickness of the head of the screw 11. The operator can therefore tighten the screw 11 until the end of the head is flush with the marks 53. The screw 11 can thereby be threaded in its entirety, or the threaded end part of the screw 11 does not have to have a length that is linked to the mounted position.

Figure 17:
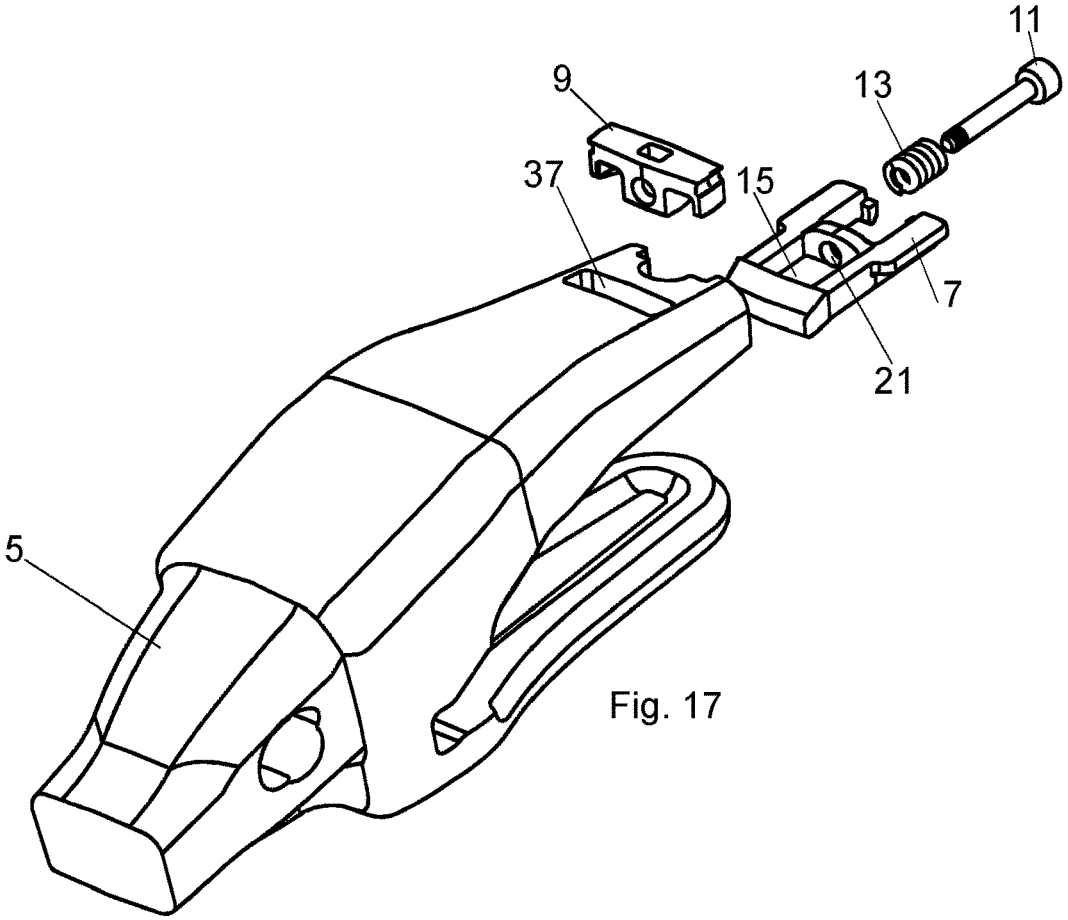
FIG. 17 shows an exploded view of a wear or protection element, specifically an adapter, with a fixing device according to the invention.

FIG. 17 shows the case in which a fixing device according to the invention is used for fixing a wear or protection element 5, which is an adapter 5 in this specific case. The fixing device comprises a base 7, with a housing 15, a screw 11 with the corresponding spring 13 and the stop 9, which will be inserted through the opening 37 until the lower part 25 thereof is housed in the housing 15. These elements meet the basic requirements of the invention indicated above.

Figure 18:
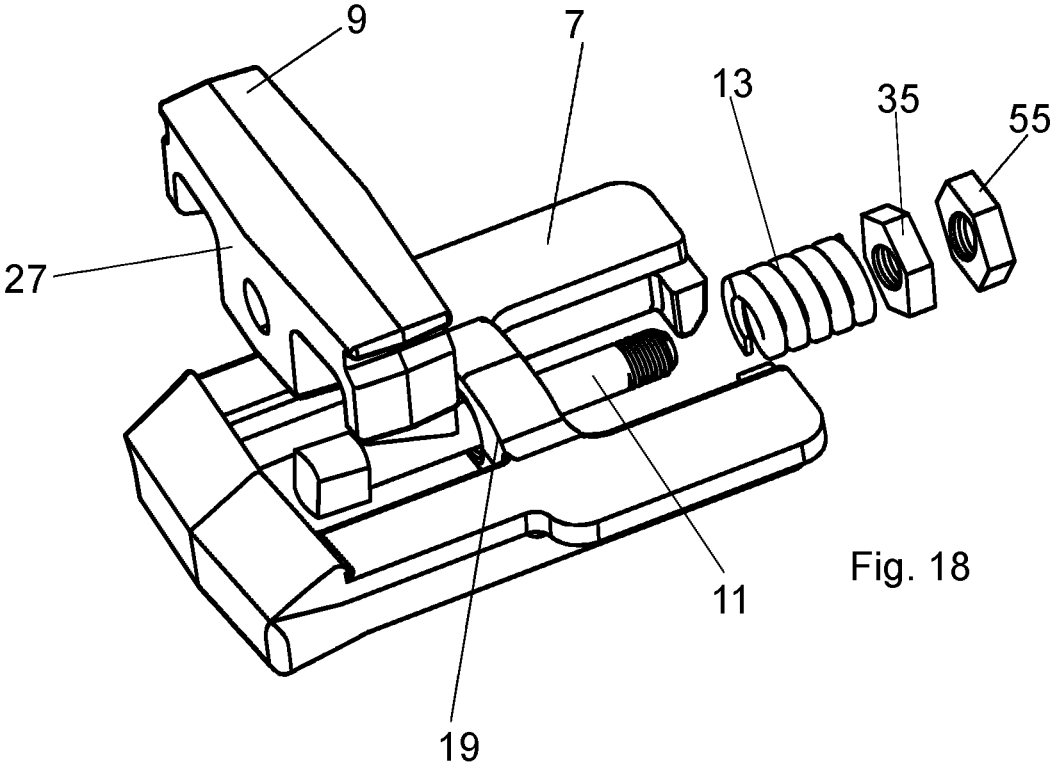
FIG. 18 shows an exploded perspective view of another embodiment of a fixing device according to the invention.
Figure 19:
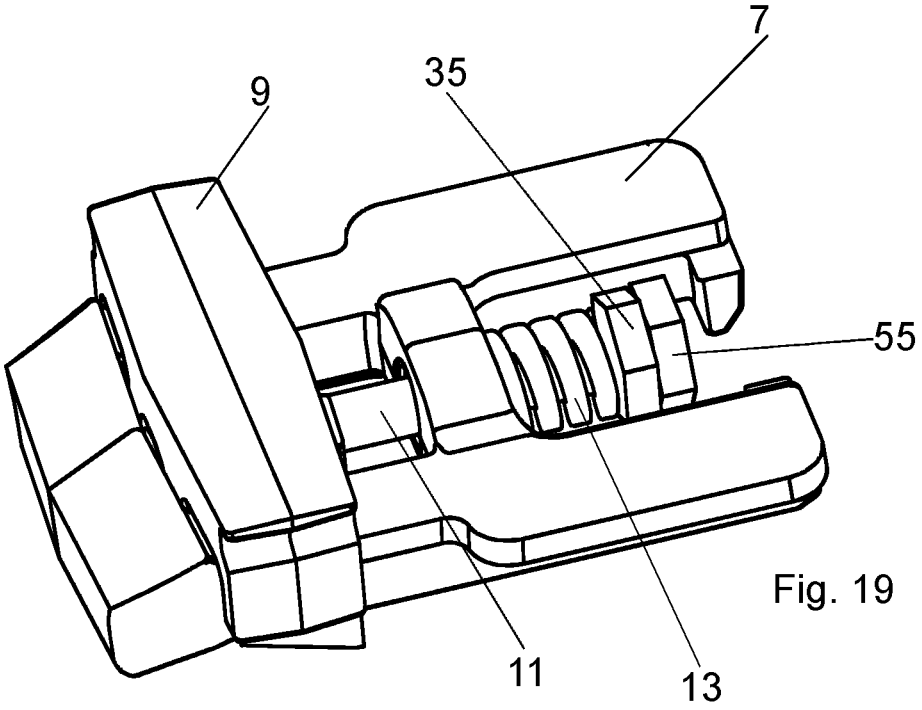
FIG. 19 shows a perspective view of the fixing device of FIG. 18 now assembled.
Figure 20:
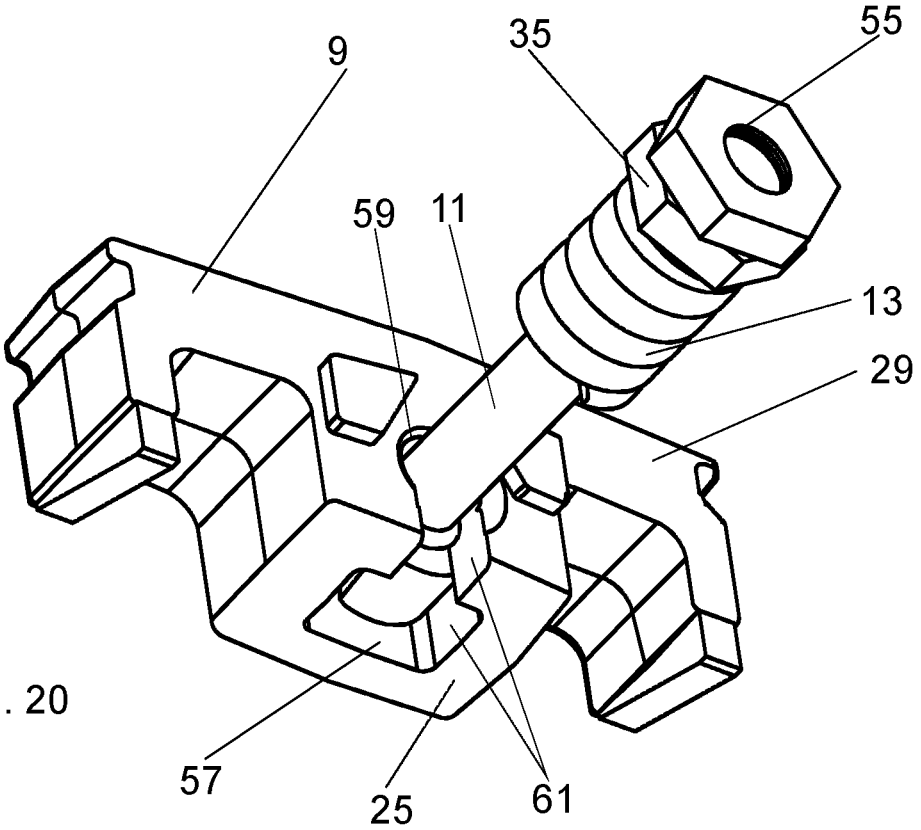
FIG. 20 shows a bottom perspective view of the stop-screw-spring-nuts assembly of the fixing device of FIG. 18.

FIGS. 18-20 show another embodiment of a fixing device according to the invention. In this embodiment, the stop 9 has a cavity 57 for housing therein the head of the screw 11 and a rear hole 59 which, in mounted position, is aligned with the access 21 or hole 21 present in the rear wall 19 of the base 7. The cavity 57 and the rear hole 59 have a side opening 61, facing down, through which the head of the screw 11 can be introduced in the cavity 57 and the bolt shank 11 can be introduced in the rear hole 59. The rear hole 59, given that it has a smaller diameter than the head of the screw 11, fixes the screw 11 on the stop 9. The spring 13 is located on the part of the shank of the screw 11 projecting from the rear wall 19 and the nut 35 is screwed on the screw 11 until partially compressing the spring 13. Finally, a second nut 55 is mounted after the nut 35, in order to prevent the nut 35 from unscrewing, while the earth movement machine is operating.

Figure 21:
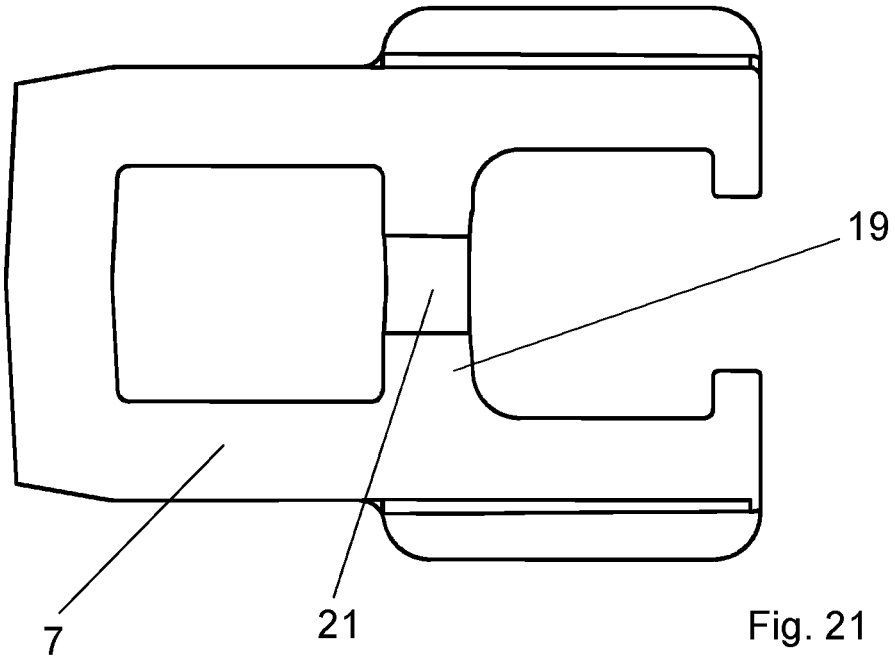
FIG. 21 shows a bottom plan view of another embodiment of a base of a fixing device.

FIG. 21 shows a base 7 having, in the rear wall 19 thereof, an access 21 as a duct opened down instead of a hole.

The invention claimed is:

1. A fixing device for fixing a wear or protection element on a bucket of an earth moving machine, comprising:

a base, where said base comprises a housing with a front wall and a rear wall, and where said rear wall has an access extending from said housing and defining a longitudinal axis, a stop, with a lower part suitable for being housed in said housing, a screw, with a first end provided with a head and a second end, and elastic means, the lower part of said stop being housed in said housing and said screw going through said access in a mounted position and one of said first end or second end being fixed on said stop, such that the other one of said first end or second end is located on the side of access opposite housing, and said elastic means are arranged between

[a] said head and said access, when said second end is fixed on said stop, or

[b] a nut arranged on said second end and said access, when said first end is fixed on said stop, and said elastic means are partially compressed, said elastic means having a length of value L0 in the direction of said longitudinal axis when they are fully compressed, said stop having a front face opposite said front wall and a rear face opposite said rear wall in said mounted position, an elastic force of said elastic means pushing said rear face towards said rear wall, and the distance between said front face and said front wall in the longitudinal direction having a value D1, the distance in the longitudinal direction, in said mounted position, between

[a] said head and said access, when said second end is fixed on said stop, or

[b] said nut arranged on said second end an said access, when said first end is fixed on said stop, having a value D2, and where D2−L0>D1 in said mounted position.

2. The fixing device according to claim 1, wherein said access is a through hole, and in that, in said mounted position, the lower part of said stop is housed in said housing and said screw goes through said access and the second end thereof is fixed on said stop, such that the head thereof is located on the side of the hole opposite the housing, and said elastic means are arranged between said head and said hole and are partially compressed, said elastic means having a length of value L0 in the direction of said longitudinal axis when they are fully compressed, said stop having a front face opposite said front wall and a rear face opposite said rear wall in said mounted position, the elastic force of said elastic means pushing said rear face towards said rear wall, and the distance between said front face and said front wall in the longitudinal direction having a value D1, the distance in the longitudinal direction between said head and said access having a value D2 in said mounted position, and, where, in said mounted position, D2−L0>D1.

3. The fixing device according to claim 2, wherein said stop has a second through hole, coaxial with said hole, and a nut housed in said second through hole, the nut being screwed onto said screw in said mounted position.

4. The fixing device according to claim 2, wherein said stop has a second hole, coaxial with said hole, and an upper hole which is in contact with said second hole, and has a nut housed in said second hole, said upper hole having a cross-section suitable for allowing the passage of said nut, and the nut being screwed onto said screw in said mounted position.

5. The fixing device according to claim 2, wherein said base has a safety wall with a safety hole, coaxial with said hole, the head of the screw being located between said hole and said safety wall said mounted position, the distance between said hole and said safety wall being less than the length of the screw in the axial direction, and the safety hole having a helical surface coaxial with the safety hole, and the head of the screw having a second helical surface complementary to said helical surface, such that said screw is only suitable for passing through said safety hole by means of rotation when both helical surfaces are facing one another.

6. The fixing device according to claim 1 further comprising positioning means for positioning said screw in said mounted position.

7. The fixing device according to claim 1, wherein in said mounted position, the lower part of said stop is housed in said housing and said screw goes through said access and said first end is fixed on said stop, such that said second end is located on the side of the access opposite the housing, and said elastic means are arranged between a nut arranged on said second end and said access and are partially compressed, said elastic means having a length of value L0 in the direction of said longitudinal axis when they are fully compressed, said stop having a front face opposite said front wall and a rear face opposite said rear wall in said mounted position, the elastic force of said elastic means pushing said rear face towards said rear wall, and the distance between said front face and said front wall in the longitudinal direction having a value D1, the distance in the longitudinal direction between said nut arranged on said end and said access (21) having a value D2 in said mounted position, and where, in said mounted position, D2−L0>D1.

8. The fixing device according to claim 7, further comprising a second nut adjacent to said nut on the side opposite said elastic means.

9. The fixing device according to claim 1, wherein said screw has a threaded end part and a non-threaded intermediate part.

10. The fixing device according to claim 1, wherein said screw has a threaded part in which the screw thread has a rectangular cross-section.

11. The fixing device according to claim 1, wherein said elastic means are a coil spring.

12. The fixing device according to claim 1, wherein said stop is provided with at least one rib, preferably on the rear face thereof, the upper edge of which is below the lower edge of the opening of the wear or protection element in said mounted position.

13. A fixing method for fixing a wear or protection element in a mounted position on a bucket of an earth moving machine by means of a fixing device according to claim 2, said wear or protection element comprising an opening, the method comprises the steps of:

[a] positioning said wear or protection element on said base,

[b] inserting said stop in said opening such that said lower part is housed in said housing, said front face is opposite said front wall and said rear face is opposite said rear wall,

[c] fixing said screw on said stop by means of a screw-in movement, the head thereof being located on the side of the hole opposite the housing, and said elastic means being arranged between the head of said screw and said hole, said screw-in movement ending before said elastic means are fully compressed, the elastic force of said elastic means pushing said rear face towards said rear wall until coming into contact with a rear wall of said opening, the distance between said front face and said front wall in the longitudinal direction having a value D1, the distance in the longitudinal direction between said head and said hole having a value D2, and the condition D2−L0>D1 being met when said screw-in movement has ended.

14. A fixing method for fixing a wear or protection element in a mounted position on a bucket of an earth moving machine by means of a fixing device according to any of claim 7, said wear or protection element comprising an opening, the method comprises the steps of:

[a] positioning said wear or protection element on said base,

[b] inserting said stop in said opening such that said lower part is housed in said housing, said front face is opposite said front wall and said rear face is opposite said rear wall, and such that said first end of said screw, previously housed in said access, is fixed on said stop,

[c] fixing said nut on said stop by means of a screw-in movement, said elastic means being arranged between said nut and said access, said screw-in movement ending before said elastic means are fully compressed, the elastic force of said elastic means pushing said rear face towards said rear wall until coming into contact with a rear wall of said opening, the distance between said front face and said front wall in the longitudinal direction having a value D1, the distance in the longitudinal direction between said nut and said access having a value D2, and the condition D2−L0>D1 being met when said screw-in movement has ended.

15. A wear or protection system for a bucket of an earth moving machine, characterized in that it comprises a fixing device according to claim 2 and a wear or protection element with an opening, where in a mounted position said wear or protection element is arranged on said base, said stop is arranged in said opening such that said lower part (25) is housed in said housing, said front face is opposite said front wall and said rear face is opposite said rear wall, said screw is fixed on said stop, the head thereof being located on the side of the hole opposite the housing, and said elastic means being arranged between said screw and said hole, said elastic means being partially compressed, the elastic force of said elastic means pushing said rear face towards said rear wall until coming into contact with a rear wall of said opening, the distance between said front face and said front wall in the longitudinal direction having a value D1, the distance in the longitudinal direction between said head and said hole (21) having a value D2, and the condition D2−L0>D1 being met.

16. A wear or protection system for a bucket of an earth moving machine, characterized in that it comprises a fixing device according to claim 7 and a wear or protection element with an opening, where in a mounted position, said wear or protection element is arranged on said base, said stop is arranged on said opening such that said lower part is housed in said housing, said front face is opposite said front wall and said rear face is opposite said rear wall, said screw is fixed on said stop, the second end thereof being located on the side of the access opposite the housing, and said elastic means being arranged between said nut and said access, said elastic means being partially compressed, the elastic force of said elastic means pushing said rear face towards said rear wall until coming into contact with a rear wall of said opening, the distance between said front face and said front wall in the longitudinal direction having a value D1, the distance in the longitudinal direction between said nut and said access having a value D2, and the condition D2−L0>D1 being met.

* * * * *